US009810115B2

(12) United States Patent
Quinton et al.

(10) Patent No.: US 9,810,115 B2
(45) Date of Patent: Nov. 7, 2017

(54) CYLINDER BLOCK WITH INTEGRATED OIL JACKET

(71) Applicant: Cummins Inc., Columbus, IN (US)

(72) Inventors: Aaron S. Quinton, Columbus, IN (US); John Jerl Purcell, III, Louisa, VA (US); Nathaniel P. Hassall, Thirsk (GB)

(73) Assignee: Cummins, Inc., Columbus, IN (US)

( * ) Notice: Subject to any disclaimer, the term of this patent is extended or adjusted under 35 U.S.C. 154(b) by 84 days.

(21) Appl. No.: 14/646,352

(22) PCT Filed: Nov. 25, 2013

(86) PCT No.: PCT/US2013/071574

§ 371 (c)(1),
(2) Date: May 20, 2015

(87) PCT Pub. No.: WO2014/085285

PCT Pub. Date: Jun. 5, 2014

(65) Prior Publication Data

US 2015/0300221 A1 Oct. 22, 2015

Related U.S. Application Data

(60) Provisional application No. 61/730,364, filed on Nov. 27, 2012.

(51) Int. Cl.
*F02B 75/22* (2006.01)
*F01M 11/02* (2006.01)
(Continued)

(52) U.S. Cl.
CPC ..... *F01M 11/02* (2013.01); *F01M 7/00* (2013.01); *F02F 7/0007* (2013.01);
(Continued)

(58) Field of Classification Search
CPC ..... F02F 7/0053; F02F 7/0007; F02F 7/0012; F02B 2075/025; F05C 2201/021; B22C 9/103; B22C 9/22
(Continued)

(56) References Cited

U.S. PATENT DOCUMENTS 4,813,408 A 3/1989 Katsumoto et al.
5,069,192 A * 12/1991 Matsumoto ..... F01M 13/02 123/41.86

(Continued)

FOREIGN PATENT DOCUMENTS

CN 1804384 A 7/2006
CN 102691561 A 9/2012

OTHER PUBLICATIONS

The International Search Report and Written Opinion of the International Searching Authority issue in PCT/US2013/071574, dated Apr. 22, 2014.

(Continued)

*Primary Examiner* — Jacob Amick
*Assistant Examiner* — Charles Brauch
(74) *Attorney, Agent, or Firm* — Foley & Lardner LLP

(57) ABSTRACT

An engine block, an engine sub-assembly, and method for providing and manufacturing an engine block. The engine block includes a plurality of cylinder barrels positioned in the engine block, at least one oil jacket channel formed in the engine block, and an oil inlet port positioned in a peripheral wall of the engine block and connected to the at least one oil jacket channel. The at least one oil jacket channel includes a plurality of curved channel sections. Each curved channel section in the plurality of curved channel sections extends about at least a portion of a circumferential portion of a respective cylinder barrel in the plurality of cylinder barrels. The at least one oil jacket channel extends between adjacent (Continued)

cylinder barrels of the plurality of cylinder barrels in the engine block.

13 Claims, 5 Drawing Sheets

(51) Int. Cl.
*F01M 7/00* (2006.01)
*F02F 7/00* (2006.01)
*F02B 75/02* (2006.01)

(52) U.S. Cl.
CPC ..... *F02F 7/0065* (2013.01); *F02F 7/0095* (2013.01); *F01M 2011/022* (2013.01); *F02B 2075/025* (2013.01); *F02F 7/0012* (2013.01); *F02F 7/0053* (2013.01); *F05C 2201/021* (2013.01)

(58) Field of Classification Search
USPC ..... 123/195 R
See application file for complete search history.

(56) References Cited

U.S. PATENT DOCUMENTS

| | | | | |
|---|---|---|---|---|
| 5,522,351 | A * | 6/1996 | Hudson | F01M 5/002 123/41.33 |
| 5,704,330 | A * | 1/1998 | Tsuchida | F01L 1/04 123/193.5 |
| 5,758,608 | A | 6/1998 | Berger et al. | |
| 6,129,133 | A | 10/2000 | Fenn et al. | |
| 6,530,356 | B2 | 3/2003 | Inoue et al. | |
| 7,225,786 | B2 * | 6/2007 | Kim | B22C 9/103 123/195 R |
| 2012/0012073 | A1 | 1/2012 | Brewer et al. | |
| 2012/0138007 | A1 | 6/2012 | Smith et al. | |

OTHER PUBLICATIONS

First Office Action issued for Chinese Patent Application No. 201380060613.8, dated Feb. 24, 2017, 7 pages.

* cited by examiner

CYLINDER BLOCK WITH INTEGRATED OIL JACKET

CROSS REFERENCE TO RELATED APPLICATIONS

The present application is a U.S. National Stage of PCT Application No. PCT/US2013/071574, filed Nov. 25, 2013, which claims priority to U.S. Provisional Application No. 61/730,364, filed Nov. 27, 2012 and entitled "CYLINDER BLOCK WITH INTEGRATED OIL JACKET," the contents of which are incorporated herein by reference in their entirety.

TECHNICAL FIELD

The present application relates to internal combustion engines having engine blocks with lubricating oil passages formed therein.

BACKGROUND

An engine block may include an elongated casted mass having a machined oil passage or rifle extending along or through the longitudinal extent of the casted mass. Producing engine blocks is a complex process and the engine block produced is generally a heavy mass. Accordingly, the requirement for additional processes such as machining an oil passage or rifle through such a heavy mass in an already complex process is disadvantageous as it may increase manufacturing time, complexity, and expense and may create additional variances from engine to engine.

SUMMARY

Various embodiments provide an engine block, an engine subassembly, and methods of manufacturing an engine block and related components.

In particular embodiments, an engine block includes a plurality of cylinder barrels positioned in the engine block, at least one oil jacket channel formed in the engine block, and an oil inlet port positioned in a peripheral wall of the engine block and connected to the at least one oil jacket channel. The at least one oil jacket channel includes a plurality of curved channel sections. Each curved channel section in the plurality of curved channel sections extends about at least a portion of a circumferential portion of a respective cylinder barrel in the plurality of cylinder barrels. The at least one oil jacket channel extends between adjacent cylinder barrels of the plurality of cylinder barrels in the engine block.

In particular embodiments, the at least one oil jacket channel is opened to the cylinder barrel in each curved channel section in the plurality of curved channel sections. The engine block may include a cylinder liner positioned in each cylinder barrel in the plurality of cylinder barrels in accordance with particular embodiments. The cylinder liner engages the curved channel section of the at least one oil jacket channel such that the cylinder liner forms a wall portion of the at least one oil jacket channel in the curved channel sections. In particular embodiments, the at least one oil jacket channel includes a first oil jacket channel and a second oil jacket channel. The first oil jacket channel is disposed on a first half of the plurality of cylinder barrels and the second oil jacket channel is disposed on a second half of the plurality of cylinder barrels opposite the first half. The engine block may further comprise a crossover oil jacket channel extending from the first half of the plurality of cylinder barrels to the second half of the plurality of cylinder barrels. In particular embodiments, each of the curved channel sections of at least one of the first oil jacket channel and the second oil jacket channel include a trough portion and an elevated portion. The elevated portion is positioned higher than the trough portion with respect to an upper end and a lower end of the respective cylinder barrel. The engine block also includes a component oil passage extending from the elevated portion to an exit port in a second peripheral wall of the engine block in particular embodiments. The engine block may be a one piece engine block in particular embodiments. In particular embodiments, the component oil passage extends from the elevated portion in a vertical direction with respect to an upper end and a lower end of the respective cylinder barrel. The engine block may be casted in particular embodiments. In particular embodiments, each curved channel section extends less than 180 degrees around the circumferential portion of the respective cylinder barrel. Each curved channel section is disposed in the same plane in particular embodiments. The at least one oil jacket channel formed in the engine block is formed without at least one of drilling the at least one oil jacket channel and machining the at least one oil jacket channel, in accordance with particular embodiments.

Other various embodiments provide a method of manufacturing an engine block. The method includes providing a mold for the engine block where the mold includes a plurality of cylinder barrel core sections coupled together and where each cylinder barrel core section in the plurality of cylinder barrel core sections includes at least one curved protrusion protruding radially outward from the cylinder barrel core wall and extending about at least a portion of a circumferential portion of the cylinder barrel core section. The method further includes casting a molten material in the mold and about the plurality of cylinder barrel core sections such that an engine block is formed having a plurality of cylinder barrels and at least one oil jacket channel, the at least one oil jacket channel including a plurality of curved channel sections. Each curved channel section in the plurality of curved channel sections extends about at least a portion of a circumferential portion of a respective cylinder barrel in the plurality of cylinder barrels. The at least one oil jacket channel extends between adjacent cylinder barrels of the plurality of cylinder barrels in the engine block.

In particular embodiments, the method also includes forming an oil inlet port in a peripheral wall of the engine block such that the oil inlet port is in fluid communication with the at least one oil jacket channel. In particular embodiments, the method also includes positioning a cylinder liner in each cylinder barrel in the plurality of cylinder barrels such that the cylinder liner engages the curved channel section of the at least one oil jacket channel and such that the cylinder liner forms a wall portion of the at least one oil jacket channel in the curved channel sections. The engine block may be cast as one piece. In particular embodiments, each curved channel section extends less than 180 degrees around the circumferential portion of the respective cylinder barrel. In particular embodiments, the at least one curved protrusion includes a first curved protrusion disposed on a first half of the cylinder barrel core section and a second curved protrusion disposed on a second half of the cylinder barrel core section opposite the first half of the cylinder barrel core section, such that the engine block is formed with includes a first oil jacket channel and a second oil jacket channel. The first oil jacket channel is disposed on a first half of the plurality of cylinder barrels and the second oil jacket channel is disposed on a second half of the plurality of cylinder barrels opposite the first half The at least one curved protrusion is configured to form at least one oil jacket channel including a trough portion and an elevated portion in particular embodiments. The elevated portion is positioned higher than the trough portion with respect to an upper end and a lower end of the respective cylinder barrel. In particular embodiments, the mold further comprises a component oil passage core configured to form a component oil passage extending from the elevated portion to an exit port in a peripheral wall of the engine block. In particular embodiments the component oil passage extends from the elevated portion in a vertical direction with respect to the upper end and the lower end of the respective cylinder barrel. In particular embodiments, the method also includes vertically drilling a component oil passage extending from the elevated portion to a peripheral wall of the engine block, wherein the elevated portion provides a reservoir for the component oil passage in the at least one oil jacket channel. In particular embodiments, the molten material includes at least one of iron and aluminum. In particular embodiments, the at least one oil jacket channel is formed in the engine block without at least one of drilling the at least one oil jacket channel and machining the at least one oil jacket channel. An example system includes the oil jacket channel (s) formed without drilling or machining, where the oil jacket channel is the portion between and connecting oil flow to the channels formed on the cylinder barrels, and the system further including a machined and/or drilled channel from an end of the engine block to the oil jacket channel(s). An example system includes the oil jacket channel(s) formed without drilling or machining, and further including channels connecting the oil jacket channel to an end of the engine block without the connecting channels being machined and/or drilled.

Other various embodiments provide an engine subassembly for facilitating lubrication in the engine block of an engine. The engine subassembly includes a cylinder barrel and at least one oil jacket channel coupled to the cylinder barrel. The at least one oil jacket channel includes a curved channel section extending about at least a portion of a circumferential portion of the cylinder barrel. The at least one oil jacket channel extends from the curved channel section to an oil inlet port. The at least one oil jacket channel includes a first oil jacket channel and a second oil jacket channel. The first oil jacket channel is disposed on a first half of the cylinder barrel and the second oil jacket channel is disposed on a second half of the cylinder barrel opposite the first half. The engine subassembly may also include a crossover oil jacket channel extending about the circumferential portion of the cylinder barrel from the curved channel section of the first oil jacket channel to the curved channel section of the second oil jacket channel.

The inventors have appreciated that the implementation and use of various embodiments may result in beneficial engine blocks, components and methods of forming engine blocks which may be implemented in a manner that efficiently and effectively distributes fluids such as lubricating oil through an engine block, reduces engine block weight, and improves the manufacturing process, reducing the manufacturing time and expense and reduces manufacturing costs. It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

The skilled artisan will understand that the drawings primarily are for illustrative purposes and are not intended to limit the scope of the subject matter described herein. The drawings are not necessarily to scale; in some instances, various aspects of the subject matter disclosed herein may be shown exaggerated or enlarged in the drawings to facilitate an understanding of different features. In the drawings, like reference characters generally refer to like features (e.g., functionally similar and/or structurally similar elements).

The features and advantages of the inventive concepts disclosed herein will become more apparent from the detailed description set forth below when taken in conjunction with the drawings.

DETAILED DESCRIPTION

Following below are more detailed descriptions of various concepts related to, and embodiments of, inventive systems, and methods of forming an engine block. It should be appreciated that various concepts introduced above and discussed in greater detail below may be implemented in any of numerous ways, as the disclosed concepts are not limited to any particular manner of implementation. Examples of specific implementations and applications are provided primarily for illustrative purposes.

Referring to FIGS. 1 and 2*a*-3*b*, an engine block 10, of the present disclosure generally includes one or more oil jackets integrally formed as oil jacket channels 18, 20 in inner annular bore surfaces 14 of each cylinder barrel 16*a*-16*f* in the engine block 10. The oil jacket channels 18, 20 are configured to receive lubricating oil used in connection with various components disposed in or connected to the engine block. Thus, the engine block 10, which may manufactured via casting as one-piece, includes, in particular embodiments, multiple oil jacket channels integrally casted into each barrel 16*a*-16*f*, thereby advantageously eliminating the need for a machined oil rifle along the length of the block.

Figure 1:
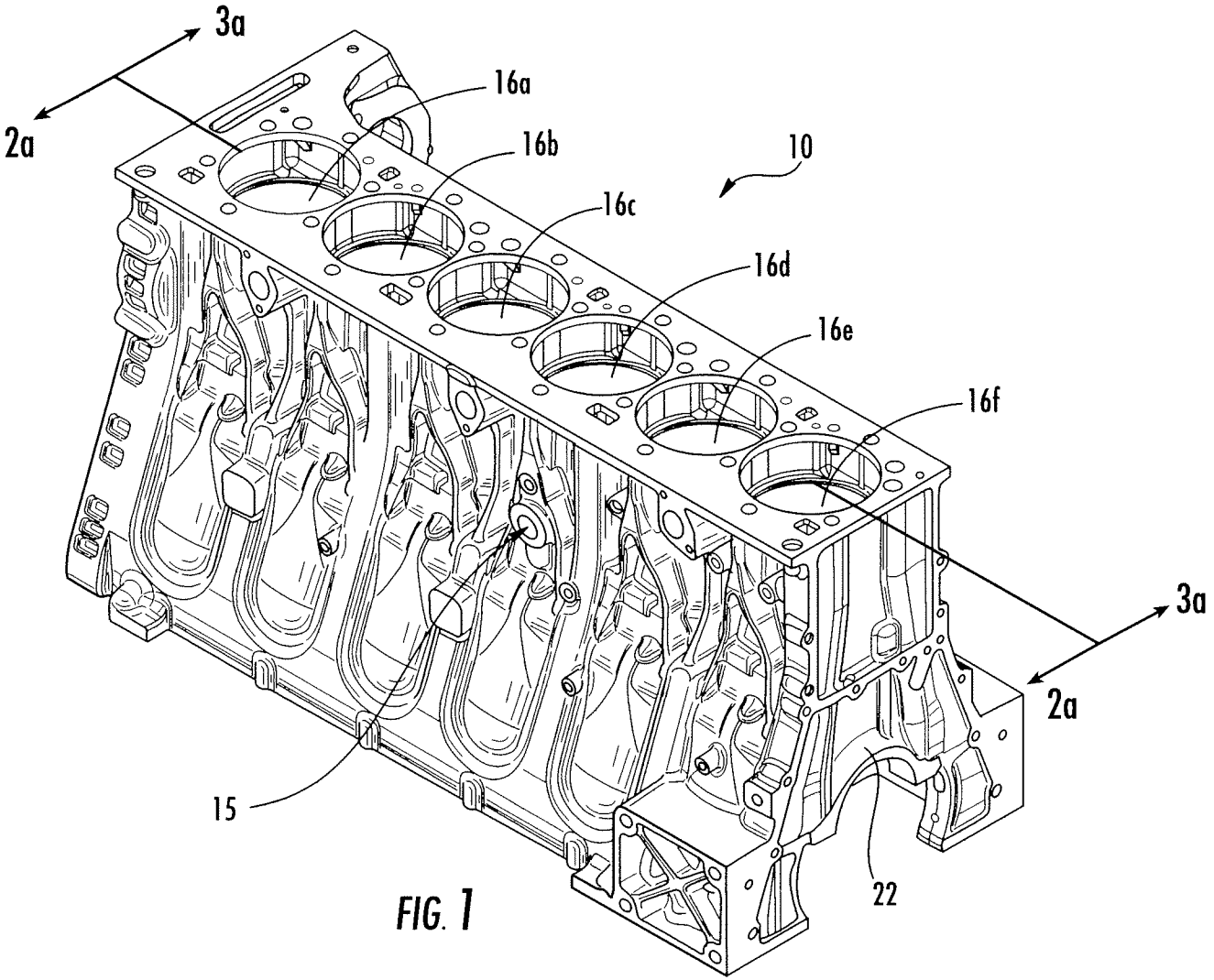
FIG. 1 is a perspective view of an engine block in accordance with exemplary embodiments.
Figure 3A:
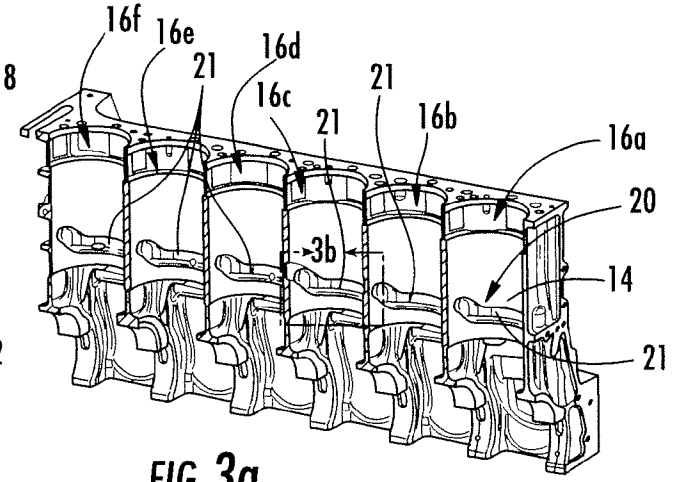
FIG. 3A is another cross sectional view of the engine block of FIG. 1.
Figure 2A:
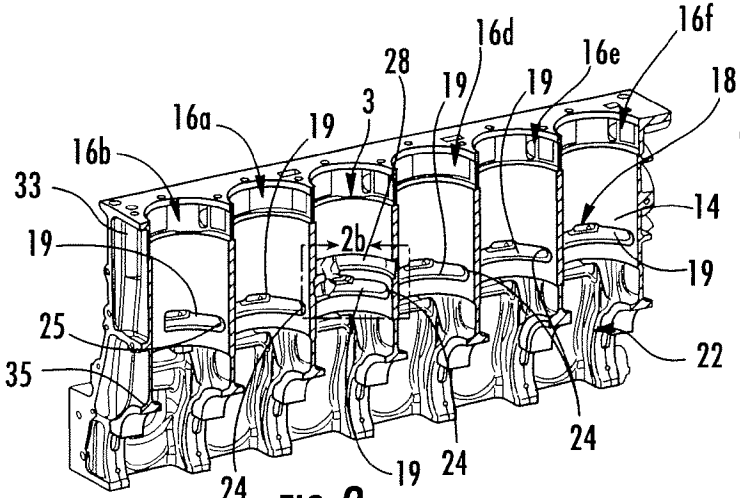
FIG. 2A is cross sectional view of the engine block of FIG. 1.
Figure 3B:
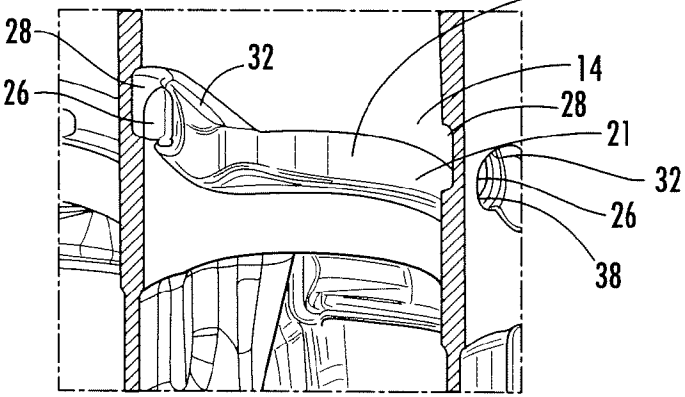
FIG. 3B is a magnified view of a portion of an oil jacket channel shown in FIG. 3A.
Figure 2B:
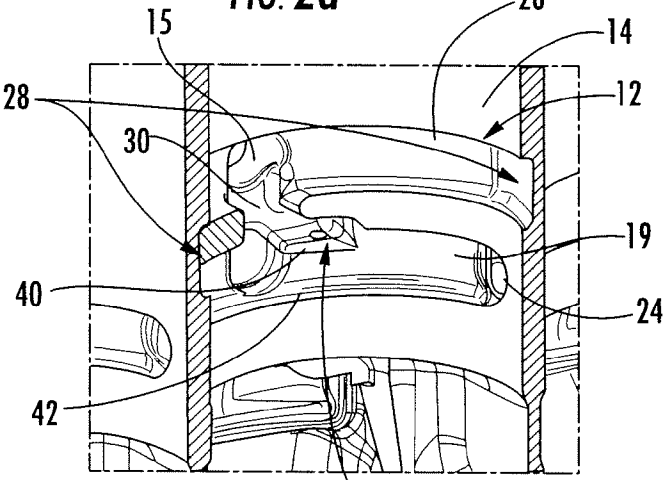
FIG. 2B is a magnified view of a portion of an oil jacket channel shown in FIG. 2A.

FIG. 1 shows the engine block 10 of the present disclosure formed by a casting method as one piece of the present disclosure. The engine block 10 includes a lubricating oil inlet port or passage 15 cast integrally in, and positioned on one side of the engine block 10 through a peripheral wall of the engine block 10. The engine block 10 is shown in FIGS. 2*a* and 3*a* in cross-sectional views taken through respective planes and in FIGS. 2*b* and 3*b* showing expanded portions of the cross sectional views of cylinder barrels 16*a*-16*f* of the engine block 10 of FIGS. 2*a* and 3*a* respectively.

In an exemplary embodiment, the at least one oil jacket includes a first oil jacket channel 18 comprised of a plurality of curved channel sections 19 connected and formed in the inner surface of each of the cylinder barrel 16*a*-16*f* on one side of the engine block 10, i.e. exhaust side view, and a second oil jacket channel 20 comprised of a plurality of curved channel sections 21 connected and formed on the inner surface of each of the cylinder barrels 16*a*-16*f* on an opposite side of the engine block 10 from the curved channel sections 19. The curved channel sections 19, 21 are configured to extend about at least a portion of the circumferential portion of the cylinder barrels 16*a*-16*f* with a section of the oil jacket channels 18, 20 extending through the block between the adjacent curved channel sections 19, 21. Each of the curved channel sections 19, 21 is formed as a channel positioned adjacent an inner side of each of the cylinder barrels 16*a*-16*f*. That is, the curved channel sections 19, 21 are formed in the lower end 35 of each of the cylinder barrels 16*a*-16*f* away from the resulting combustion chamber at an upper end 33 of the cylinder and closer to the opening to the crankshaft housing 22 portion of the engine block 10. The first oil jacket channel 18 is fluidly connected by a plurality of first connector channel sections 24 extending transversely through the barrel walls between adjacent barrels/cylinders. The first connector channel section 24 connects adjacent ends of the curved channel sections 19 formed in adjacent barrels to permit oil flow to all the curved channel sections 19. In this way, the curved channel sections 19 are positioned end-to-end. The curved channel sections 21 are similarly each formed adjacent an inner side of the cylinder barrels 16*a*-16*f*. The adjacent curved channel sections 21 are fluidly connected at adjacent end portions by second connector passages 26 so that all the curved channel sections 21 are fluidly connected by the second connector passages 26 to permit oil flow to all the curved channel sections 21 of the second oil jacket channel 20.

In particular embodiments, each of the curved channel sections 19 of the first oil jacket channel 18 extends about at least a portion of a circumferential portion of the respective barrel less than 180 degrees for all the cylinder barrels 16*a*-16*f*. In an exemplary embodiment, the curved channel sections 19 of the first oil jacket channel 18 are positioned in a single plane extending transversely through the engine block 10. In particular embodiments, each of the curved channel sections 21 of the second oil jacket channel 20 also extend around less than 180 degrees of the circumference of each of the cylinder barrels 16*a*-16*f*. In a particular embodiment, the second oil jacket channel 20 is also positioned in a single plane extending transversely through the engine block 10. In various embodiments, the first and second oil jacket channels 18, 20 are generally positioned in a common transverse plane.

In a particular embodiment, the cylinder barrel 16*c* includes a crossover oil jacket 28 positioned longitudinally between the curved channel section 19 and an outer end of the cylinder barrel 16*c*. The crossover oil jacket 28 is in fluid communication with the lubricating oil inlet port 15 and with the curved channel section 19 (in cylinder barrel 16*c*) at a lower opening 30. The crossover oil jacket 28 extends circumferentially in both directions around the cylinder barrel 16*c* to connect with both ends of the curved channel section 21 positioned in the cylinder barrel 16*c*, thereby connecting the first oil jacket channel 18 and the second oil jacket channel 20. In this manner, oil may flow from the lubricating oil inlet port 15 into the curved channel section 19 of the oil jacket channel 18 to the adjacent curved channel section 19 as well as into the crossover oil jacket 28, via the lower opening 30 in the crossover oil jacket 28, and the curved channel sections 21 of the second oil jacket channel 20. Thus, in an illustrated exemplary embodiment, the first oil jacket channel 18 and the second oil jacket channel 20 are connected at only one location, such as at one barrel or cylinder positioned intermediate the end barrels/cylinders.

Figure 4:
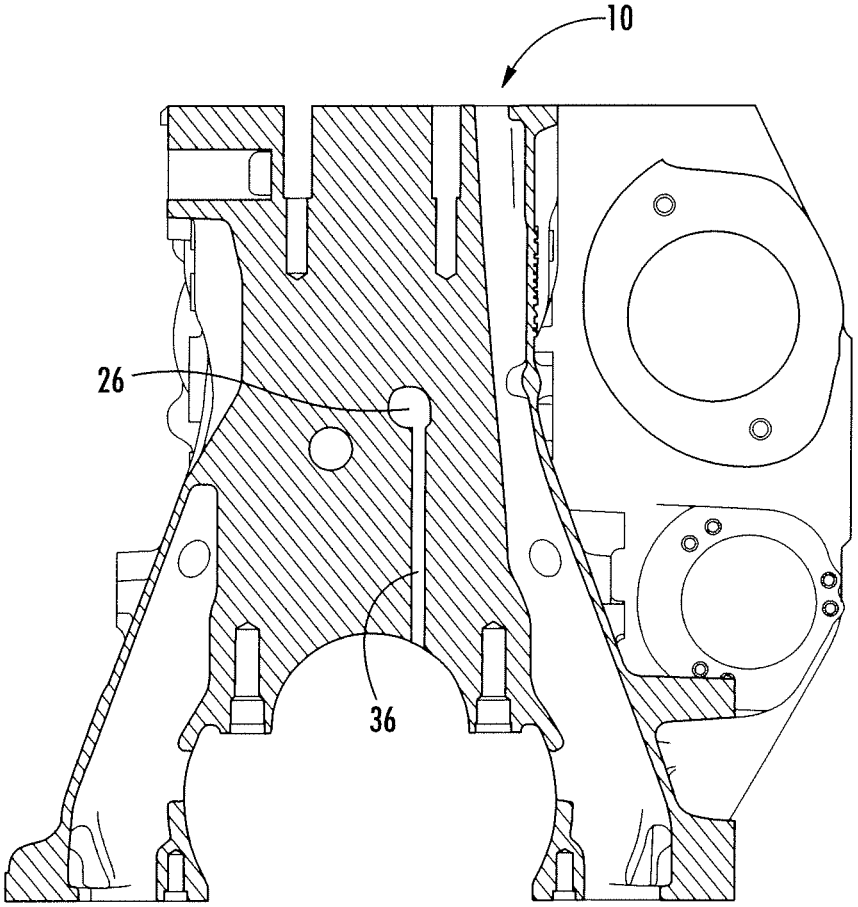
FIG. 4 is another cross sectional view of the engine block of FIG. 1

In a particular embodiment, the curved channel sections 21 are each formed with elevated end portions 32 and a trough portion 34 positioned between the elevated end portions 32. The elevated end portion 32 is positioned higher than the trough portion with respect to the upper end 33 and the lower end 35 of the respective cylinder barrel. The trough portion 34 functions as a reservoir to hold a quantity of oil during engine shut-down to minimize the time required to build pressure in the high pressure lubricating oil circuit on subsequent engine start-up, thereby ensuring delivery of sufficient oil to components to minimize component wear and the likelihood of component failure due to inadequate lubrication. The engine block 10 may include one or more component oil passages 36 extending from the elevated end portion 32 through the cylinder to a peripheral wall of the engine block 10 (FIG. 4) to feed oil from the second oil jacket channel 20 downwardly to other engine components such as crankshaft bearings and connecting rods. Each of the component oil passages 36 includes an inlet port 38 opening into the second connector passages 26 at the elevated end portions 32 of the curved channel sections 21. In this manner, the oil level in the trough portion 34 is maintained and not drained by gravity to the engine components during engine shut-down.

Referring to FIG. 2*b*, an elevated landing 40 is positioned above a lower surface 42 of each curved channel section 19, in accordance with exemplary embodiments. A piston cooling nozzle (PCN) oil passage 44 may open onto the elevated landing 40 to provide a flow of oil from the oil jacket to the piston cooling nozzle (not shown). By positioning the opening of the PCN oil passage 44 near the top of the curved channel section 19, the oil in the curved channel section 19 inhibits oil from draining through the PCN oil passage 44 under the force of gravity, for example during engine shut-down. It should be noted that the curved channel sections 19, 21 may connect with other oil passages to provide lubricating oil to other components such as the cylinder head, gear train, pressure regulator valve, etc.

Figure 6:
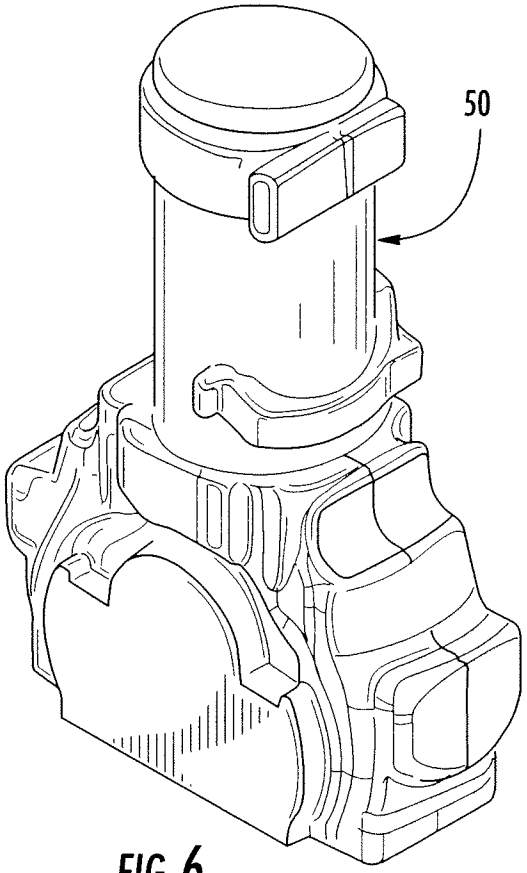
FIG. 6 is provides a perspective of the cylinder core of FIG. 5
Figure 5:
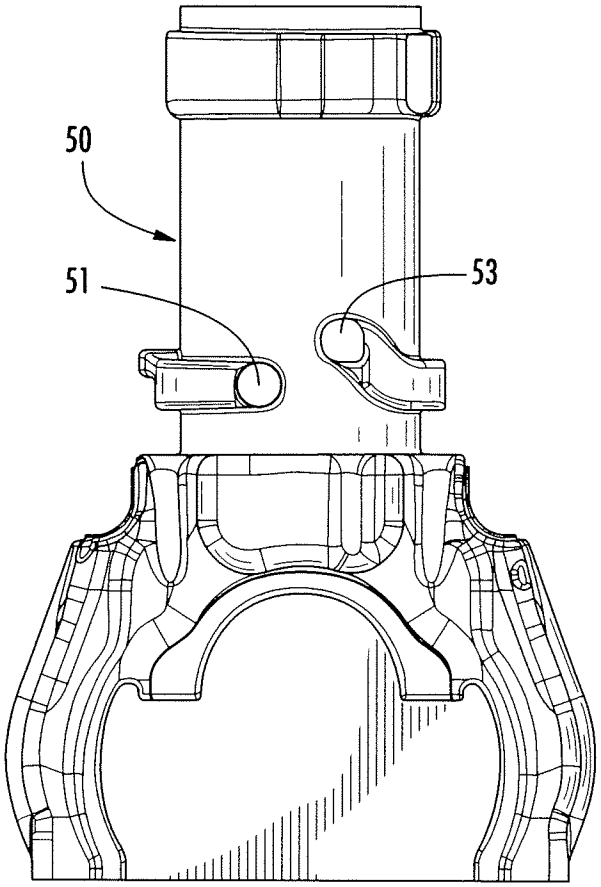
FIG. 5 is a side view of a cylinder core in accordance with exemplary embodiments.

FIG. 5 is a side view of a cylinder barrel core 50 in accordance with exemplary embodiments and FIG. 6 is provides a perspective of the cylinder core of FIG. 5. The cylinder barrel core 50 illustrated in FIGS. 5 and 6, is used in the casting process or method to form the engine block 10, and specifically, in the exemplary embodiment, the cylinder barrels 16*a*-16*f*. As discussed herein, the engine block 10 may be formed as one piece by a casting method, such as a sand casting method. In accordance with exemplary embodiments, a mold may be formed for the cast. The mold may be composed of one or more parts connected or integrally formed. The mold may include a plurality of cylinder barrel core sections, such as the cylinder barrel core 50. The cylinder barrel core 50 includes features shaped and positioned to integrally form the oil jacket channels in a one-piece cylinder block casting. For example the cylinder barrel cores 50 may be coupled together (via a base core, housing, or extension there between). Each cylinder barrel core 50 may include one or more curved protrusions, such as protrusions 51, 53, protruding radially outward from cylinder wall of the cylinder barrel core 50 and extending about at least a portion of a circumferential portion of the cylinder and configured to form the curved channel sections 19, 21 of the oil jacket channels 18, 20.

Figure 7B:
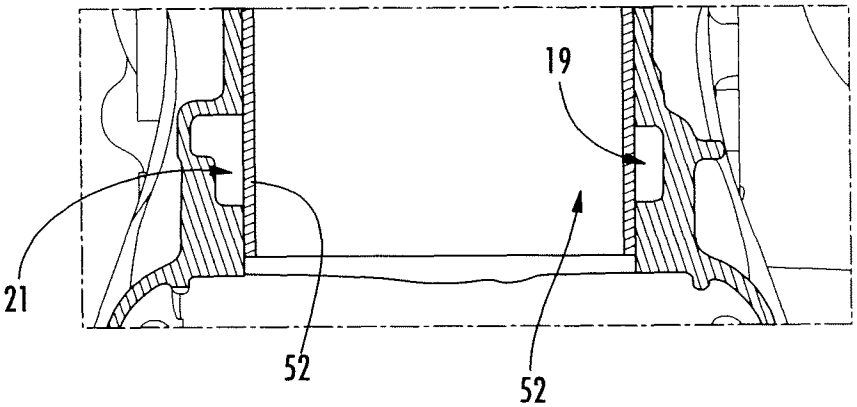
FIG. 7A and 7B provide cross sectional views of an engine block including a cylinder liner in accordance with exemplary embodiments.
Figure 7A:
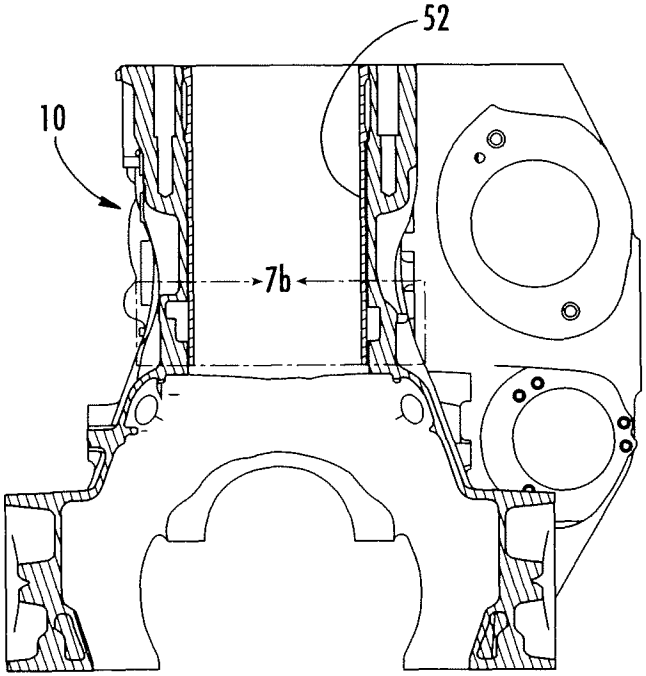

As shown in FIGS. 7*a* and 7*b*, the open sides of the curved channel sections 19 and 21 of the oil jacket channels 18, 20 and the crossover oil jacket 28 may be closed by the cylinder liner 52. The cylinder liner 52 may be pressed into the bore during engine assembly in particular embodiments, thereby engaging the channel and forming a wall portion of the oil jacket channel 18, 20 at the curved channel sections 19, 21. This closure by the cylinder liner 52 and the fluid connection between curved channel sections provides an enclosed fluidly continuous oil jacket channel along the length of the cylinder block from one end cylinder barrel 16*a* to the other end cylinder barrel 16*f*. Incorporating this feature into the cylinder block casting reduces material and machining costs associated with making an engine block, and additionally reduces stress concentrations typically associated with the conventional machined oil rifle. This design may consist of either single or multiple oil jackets in the cylinder barrels.

As utilized herein, the terms "approximately," "about," "substantially" and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described without restricting the scope of these features to the precise numerical ranges provided. Accordingly, these terms should be interpreted as indicating that insubstantial or inconsequential modifications or alterations of the subject matter described and are considered to be within the scope of the disclosure.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

For the purpose of this disclosure, the term "coupled" means the joining of two members directly or indirectly to one another. Such joining may be stationary or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It should be noted that the orientation of various elements may differ according to other exemplary embodiments, and that such variations are intended to be encompassed by the present disclosure. It is recognized that features of the disclosed embodiments can be incorporated into other disclosed embodiments.

It is important to note that the constructions and arrangements of apparatuses or the components thereof as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

All literature and similar material cited in this application, including, but not limited to patents and patent applications, regardless of the format of such literature and similar materials, are expressly incorporated by reference in their entirety. In the event that one or more of the incorporated literature and similar materials differs from or contradicts this application, including but not limited to defined terms, term usage, describes techniques, or the like, this application controls.

While various inventive embodiments have been described and illustrated herein, those of ordinary skill in the art will readily envision a variety of other mechanisms and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

Also, the technology described herein may be embodied as a method, of which at least one example has been provided. The acts performed as part of the method may be ordered in any suitable way unless otherwise specifically noted. Accordingly, embodiments may be constructed in which acts are performed in an order different than illustrated, which may include performing some acts simultaneously, even though shown as sequential acts in illustrative embodiments.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to.

The claims should not be read as limited to the described order or elements unless stated to that effect. It should be understood that various changes in form and detail may be made by one of ordinary skill in the art without departing from the spirit and scope of the appended claims. All embodiments that come within the spirit and scope of the following claims and equivalents thereto are claimed.

The invention claimed is:

1. A method of manufacturing an engine block, the method comprising:

providing a mold for the engine block, the mold including a plurality of cylinder barrel core sections coupled together, each cylinder barrel core section in the plurality of cylinder barrel core sections including at least one curved protrusion protruding radially outward from a cylinder barrel core wall and extending about at least a portion of a circumferential portion of the cylinder barrel core section; and casting a molten material in the mold and about the plurality of cylinder barrel core sections such that an engine block is formed having a plurality of cylinder barrels and at least one oil jacket channel, the at least one oil jacket channel including a plurality of curved channel sections, each curved channel section in the plurality of curved channel sections formed directly on at least a portion of a circumferential portion of an inner surface of a respective cylinder barrel in the plurality of cylinder barrels, wherein the at least one oil jacket channel extends between adjacent cylinder barrels of the plurality of cylinder barrels in the engine block.

2. The method of claim 1, further comprising forming an oil inlet port in a peripheral wall of the engine block such that the oil inlet port is in fluid communication with the at least one oil jacket channel.

3. The method of claim 1, further comprising positioning a cylinder liner in each cylinder barrel of the plurality of cylinder barrels, the cylinder liner engaging the curved channel section of the at least one oil jacket channel such that the cylinder liner forms a wall portion of the at least one oil jacket channel in the curved channel sections.

4. The method of claim 1, wherein the engine block is cast as one piece.

5. The method of claim 1, wherein each curved channel section extends less than 180 degrees around the circumferential portion of the respective cylinder barrel.

6. The method of claim 1, wherein the at least one curved protrusion includes a first curved protrusion disposed on a first half of the cylinder barrel core section and a second curved protrusion disposed on a second half of the cylinder barrel core section opposite the first half of the cylinder barrel core section, such that the engine block is formed with includes a first oil jacket channel and a second oil jacket channel, wherein the first oil jacket channel is disposed on a first half of the plurality of cylinder barrels and wherein the second oil jacket channel is disposed on a second half of the plurality of cylinder barrels opposite the first half.

7. The method of claim 6, wherein the at least one curved protrusion is configured to form at least one oil jacket channel including a trough portion and an elevated portion, the elevated portion positioned higher than the trough portion with respect to an upper end and a lower end of the respective cylinder barrel.

8. The method of claim 7, wherein the mold further comprises a component oil passage core configured to form a component oil passage extending from the elevated portion to an exit port in a peripheral wall of the engine block.

9. The method of claim 8, wherein the component oil passage extends from the elevated portion in a vertical direction with respect to the upper end and the lower end of the respective cylinder barrel.

10. The method of claim 7, further comprising vertically drilling a component oil passage extending from the elevated portion to a peripheral wall of the engine block, wherein the elevated portion provides a reservoir for the component oil passage in the at least one oil jacket channel.

11. The method of claim 1, wherein the molten material comprises at least one of iron and aluminum.

12. The method of claim 1, wherein the at least one oil jacket channel formed in the engine block is formed without drilling the at least one oil jacket channel.

13. The method of claim 1, wherein the at least one oil jacket channel formed in the engine block is formed without machining the at least one oil jacket channel.

* * * * *